US006680711B2

(12) United States Patent
Desargant et al.

(10) Patent No.: US 6,680,711 B2
(45) Date of Patent: Jan. 20, 2004

(54) COINCIDENT TRANSMIT-RECEIVE BEAMS PLUS CONICAL SCANNED MONOPULSE RECEIVE BEAM

(75) Inventors: Glen J. Desargant, Fullerton, CA (US); Albert L. Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/191,820

(22) Filed: Jul. 9, 2002

(65) Prior Publication Data

US 2003/0128169 A1 Jul. 10, 2003

Related U.S. Application Data

(60) Provisional application No. 60/346,577, filed on Jan. 8, 2002.

(51) Int. Cl.[7] ..... H01Q 13/00

(52) U.S. Cl. ..... 343/781 CA; 343/781 P; 343/909

(58) Field of Search ..... 343/781 CA, 781 P, 343/909, 781 R, 782, 761; H01Q 13/00

(56) References Cited

U.S. PATENT DOCUMENTS 4,489,331 A * 12/1984 Salvat et al. ..... 343/753
4,866,454 A * 9/1989 Droessler et al. ..... 343/725
5,307,077 A * 4/1994 Branigan et al. ..... 343/720
5,373,302 A * 12/1994 Wu ..... 343/781 P

* cited by examiner

*Primary Examiner*—Hoanhanh Le
(74) *Attorney, Agent, or Firm*—Harness Dickey & Pierce P.L.C.

(57) ABSTRACT

An antenna system includes a feedhorn, main reflector, sub-reflector, and frequency selective member. The sub-reflector includes an axially symmetrical reflecting surface. The frequency selective member includes an axially non-symmetrical reflecting surface. The frequency selective member transmits signals having a first frequency from the feedhorn to the sub-reflector. These signals are symmetrically reflected by the sub-reflector to the main reflector. The frequency selective member reflects signals having a second frequency from the main reflector to the feedhorn. These signals are reflected at a small conical angle by the frequency selective member to the feedhorn. In this way, the present transmit/receive system provides coincident transmit and receive signals with only conically scanned receive signals.

20 Claims, 1 Drawing Sheet

COINCIDENT TRANSMIT-RECEIVE BEAMS PLUS CONICAL SCANNED MONOPULSE RECEIVE BEAM

CROSS-REFERENCE TO RELATED APPLICATIONS

This application claims priority from U.S. provisional application Ser. No. 60/346,577, filed Jan. 8, 2002.

FIELD OF THE INVENTION

The present invention generally relates to communication systems and more particularly to a transmit/receive antenna system for generating a single conical scanned monopulse beam for accurately pointing the system at a single Ku-band communications satellite without interfering with adjacent satellites.

BACKGROUND OF THE INVENTION

Numerous communications satellites are now in geo-stationary orbit around the earth to facilitate global communications. Such satellites are located at a fixed position relative to the earth. These satellites are often located very close to one another in terms of circumferential alignment relative to the earth. In fact, many communications satellites are located about two degrees from one another.

One advantage of closely locating such geo-stationary communications satellites is that many satellites become available for use by earth bound (or near earth bound) antenna systems. Unfortunately, one disadvantage of placing satellites so close to one another is that miscommunication due to interference with adjacent satellites may occur. The potential for interference with adjacent satellites increases if the satellite is communicating with an earth based antenna system which is moveable rather than fixed.

Antenna systems which are designed to be moveable relative to the earth while communicating with a geo-stationary communications satellite include those placed on moving platforms such as airplanes, ships, and automobiles. The most common type of such mobile antenna systems is a receive-only antenna system which has no transmit capability. Advantageously, since no signal is sent from a receive-only system to the satellite, receive-only systems do not interfere with adjacent satellites in geo-stationary orbit.

Unfortunately, receive-only systems have limited capabilities. For example, receive-only systems are mainly for used for viewing direct television and dish satellite television signals. Modern communication needs commonly require both a receive signal and a transmit signal.

To provide the required transmit signal while maintaining the ability to receive signals, a transmit/receive antenna system is necessary. Unfortunately, conventional transmit/receive systems that transmit signals to geo-stationary satellites conically scan both the receive signal and the transmit signal. Conically scanning the transmit signal causes the resulting beam to be transmitted at a conical angle relative to the line of sight of the antenna system. Since the transmit beam is transmitted outboard of the line of sight, interference with adjacent satellites can occur.

In view of the foregoing, it would be desirable to provide a transmit/receive antenna system for a moving platform that does not scan the transmit beam so that the system could accurately track a desired communications satellite without interfering with adjacent satellites.

SUMMARY OF THE INVENTION

The above and other objects are provided by an antenna system including a feedhorn, main reflector, sub-reflector, and frequency selective member. The sub-reflector includes a symmetrical reflecting surface coaxially aligned with the feedhorn and main reflector. The frequency selective member includes a non-symmetrical reflecting surface coaxially aligned between the feedhorn and sub-reflector. The frequency selective member transmits signals having a first frequency from the feedhorn to the sub-reflector. The sub-reflector reflects these signals to the main reflector. The frequency selective member reflects signals having a second frequency from the main reflector to the feedhorn.

In operation, the non-symmetrical reflecting surface of the frequency selective member rotates relative to the main reflector and feedhorn. The non-symmetry and rotation of the reflecting surface of the frequency selective member reflects receive signals at a small angle relative to the line of sight of the antenna system. The symmetry of the reflecting surface of the sub-reflector reflects transmit signals axially symmetric relative to the line of sight. In this way, the transmit/receive system only conically scans the receive signals.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
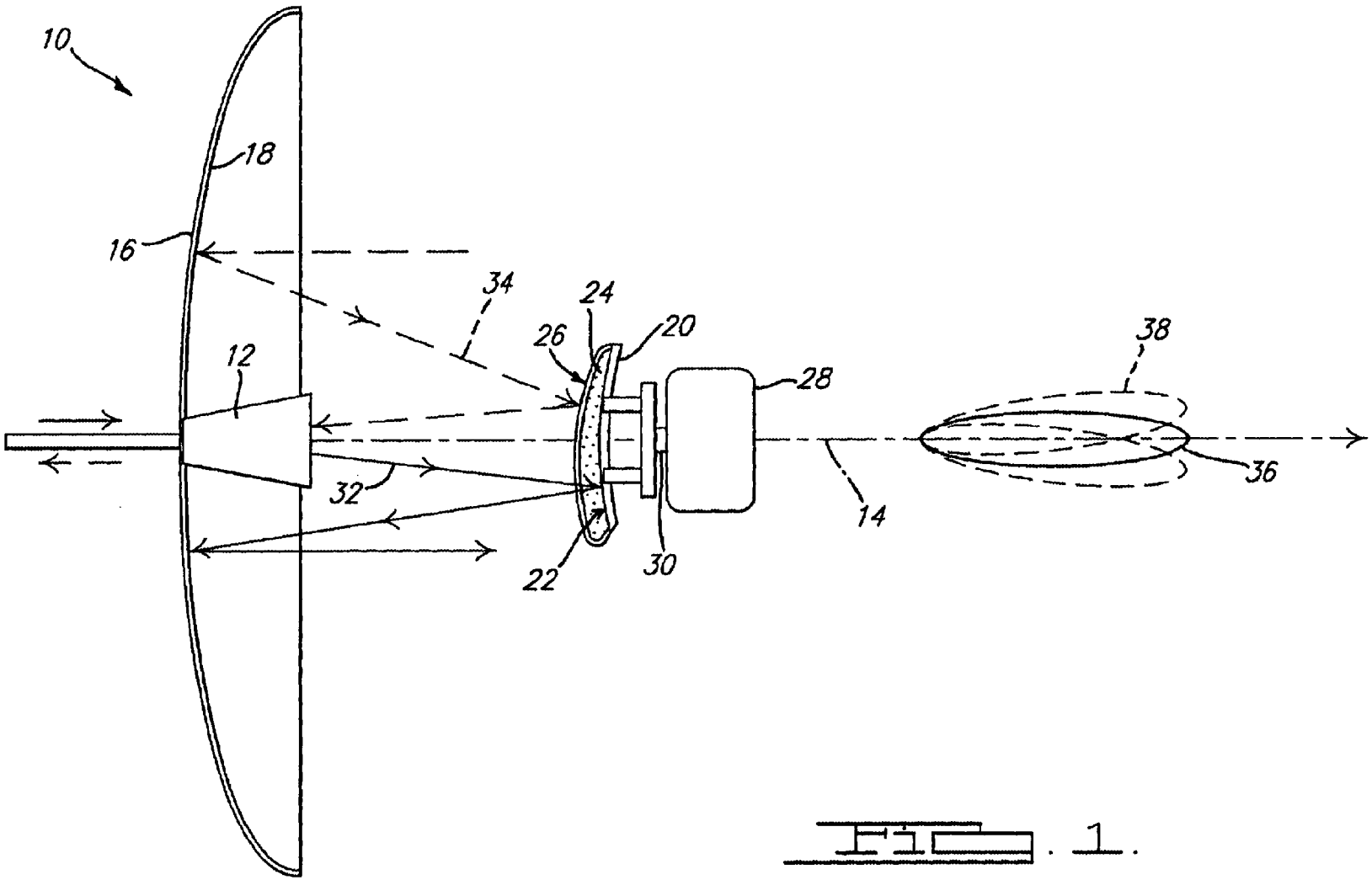
FIG. 1 is a schematic illustration of a transmit/receive antenna system in accordance with the teachings of the present invention.

The following description of the preferred embodiments is merely exemplary in nature and is in no way intended to limit the invention, its application, or uses.

FIG. 1 illustrates an antenna system incorporating the teachings of the present invention generally at 10. The antenna system 10 is preferably an axially symmetrical Cassegrain reflector system. The system 10 includes a diverging feedhorn 12 having a line of sight axis 14. A main reflector 16 is coaxially disposed about the feedhorn 12 relative to the axis 14. The main reflector 16 has a concave active surface 18 operable for reflecting energy, preferably in the form of communication signals, therefrom. The active surface 18 is preferably symmetric relative to the axis 14.

The system 10 also includes a sub-reflector 20 located in signal communicating relation relative to the feedhorn 12 and main reflector 16. That is, the sub-reflector is positioned to receive and transmit communication signals between the feedhorn 12 and main reflector 16. Preferably, the sub-reflector 20 is spaced apart from the main reflector 16 and coaxially aligned along the axis 14. The sub-reflector 20 is preferably formed of solid metal and includes a convex energy reflecting surface 22 facing the main reflector 16. The reflecting surface 22 is symmetric relative to the axis 14.

A frequency selective member 24 is also disposed in signal communicating relation relative to the feedhorn 12 and main reflector 16. As such, the frequency selective member 24 also receives and transmits communication signals between the feedhorn 12 and main reflector 16. Preferably, the frequency selective member 24 is rotatably disposed between the main reflector 16 and the sub-reflector 20 and coaxially aligned along the axis 14. In this way, the frequency selective member 24 can intercept and filter all signals from the main reflector 16 or feedhorn 12 prior to the signals reaching the sub-reflector 20.

In a highly preferred embodiment, the frequency selective member 24 is coupled to the sub-reflector 20 such that the frequency selective member 24 is spaced apart from the main reflector 16. In an alternate embodiment, the reflecting surface 22 of the sub-reflector 20 is a second layer of the frequency selective member 24. In either case, when the frequency selective member 24 is mounted to the sub-reflector 20, the sub-reflector 20 is also rotatable relative to the axis 14, feedhorn 12, and main reflector 16.

The frequency selective member 24 includes a convex reflecting surface 26 facing the main reflector 16. The reflecting surface 26 is non-symmetric relative to the axis 14. Although other non-symmetric designs exist, a canted reflecting surface, which is angled or offset relative to the axis 14, is preferred. In one particularly preferred embodiment, the frequency selective member 24 takes the form of a non-symmetrical, rotating, diplexer.

A stepper motor 28 includes a shaft 30 coupled to the frequency selective member 24 by way of the sub-reflector 20. The shaft 30 is preferably aligned along the axis 14. Operation of the stepper motor 28 rotates the frequency selective member 24 relative to the axis 14, feedhorn 12 and main reflector 16.

In operation, the frequency selective member 24 transmits signals 32 having a first frequency and reflects signals 34 having a second frequency. As such, first or transmit signals 32 pass through the frequency selective member 24 and reflect off of the symmetrical reflecting surface 22 of the sub-reflector 20. Such transmit signals 32 form a beam 36 axially aligned with the axis 14.

On the other hand, the non-symmetrical and rotating reflecting surface 26 of the frequency selective member 24 reflects second or receive signals 34. Such receive signals 34 form a conically scanned monopulse 38 which is offset by a small angle relative to the axis 14. In this way, the transmit signals 32 and receive signals 34 are coincident but only the receive signals 34 are conically scanned.

More particularly, in a transmit mode, the feed horn 12 feeds a transmit signal 32 to the frequency selective member 24. The frequency of the transmit signal 32 enables the transmit signal 32 to pass through the frequency selective member 24 to the sub-reflector 20. Although other frequencies may exist, a transmit signal frequency between about 14 and about 14.5 GHz is preferred. As such, the material of the frequency selective member 24 is selected to pass this frequency range.

The symmetric reflecting surface 22 of the sub-reflector 20 reflects the transmit signal 32 to the main reflector 16. The active surface 18 of the main reflector 16 reflects the transmit signal 32 to a desired satellite such as a Ku-band communications satellite. Since the reflecting surface 22 of the sub-reflector 20 is symmetric relative to the axis 14, the transmit signal 32 reflects as an axially symmetric beam 36 with no conical scanning.

In a receive mode, a desired satellite delivers a receive signal 34 to the main reflector 16. The active surface 18 of the main reflector 16 reflects the receive signal 34 to the frequency selective member 24. The frequency of the receive signal 34 enables the receive signal 34 to be reflected by the reflecting surface 26 of the frequency selective member 24. Although other frequencies may exist, a receive signal frequency between about 11.2 and about 12.7 GHz is preferred. As such, the material of the frequency selective member 24 is selected to reflect this frequency range.

The reflecting surface 26 reflects the receive signal 34 to the feedhorn 12. Since the reflecting surface 26 of the frequency selective member 24 is non-symmetric and rotating, the receive signal 34 is reflected at a small angle relative to the axis 14 to form a conically scanned monopulse 38. The conical angle of the reflected receive signal 34 or monopulse 38 is determined by the non-symmetric design or canting of the reflecting surface 26 relative to the axis 14.

If desired, an error signal may be generated whenever the receive signal 34 exceeds a given conical angle of the line of sight axis 14. This is accomplished by tracking the radiated satellite signal in null or cross-over of the conically scanned monopulse 38. The error signal is developed from the detected pattern level change with angle from the line of sight axis 14. The error signal is processed and sent to azimuth and elevation motor controllers (not illustrated) to accurately point the antenna system 10.

In view of the foregoing it can be appreciated that the present invention provides a transmit/receive antenna system with conical scanning of the receive beam only. The transmit beam axis remains fixed along the line of sight to the desired satellite. This innovative design enables a transmit/receive Cassegrain reflector antenna on a moving platform (airplane, car, ship, etc) to accurately track a desired Ku-band communications satellite without interfering with adjacent Ku-band satellites.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An antenna comprising:

a main reflector;

a feedhorn proximate said main reflector;

a sub-reflector mounted in signal communicating relation relative to said main reflector and said feedhorn, said sub-reflector including a symmetrical reflecting surface; and a frequency selective member mounted in signal communicating relation relative to said main reflector and said feedhorn, said frequency selective member including a non-symmetrical reflecting surface.

2. The antenna of claim 1 wherein said frequency selective member is rotatable about a line of sight axis of said main reflector.

3. The antenna of claim 1 wherein said feedhorn and main reflector are disposed on one side of said frequency selective member and said sub-reflector is disposed on another side of said frequency selective member, said frequency selective member being adapted to pass a first signal from said feedhorn to said sub-reflector and reflect a second signal from said main reflector to said feedhorn.

4. The antenna of claim 3 wherein said first signal has a frequency of about 14 to about 14.5 GHz.

5. The antenna of claim 3 wherein the second signal has a frequency of about 11.2 to about 12.7 GHz.

6. The antenna of claim 3 wherein said first signal has a frequency of about 14 to about 14.5 GHz and said second signal has a frequency of about 11.2 to about 12.7 GHz.

7. The antenna of claim 1 wherein said frequency selective member is mounted to said sub-reflector.

8. The antenna of claim 7 wherein said frequency selective member and said sub-reflector are rotatable.

9. An antenna system comprising:

a main reflector having an active surface;

a sub-reflector spaced apart from said main reflector, a reflecting surface of said sub-reflector being symmetrical relative to a line of sight axis of said active surface of said main reflector; and a frequency selective member rotatably disposed between said active surface of said main reflector and said symmetrical reflecting surface of said sub-reflector, a reflecting surface of said frequency selective member being non-symmetrical relative to said line of sight axis and coaxially aligned with said symmetrical reflecting surface of said sub-reflector.

10. The antenna system of claim 9 wherein said frequency selective member is coupled to said sub-reflector.

11. The antenna system of claim 9 further comprising a motor rotatably coupled to said frequency selective member.

12. The antenna system of claim 9 further comprising a feed horn disposed in a signal transmitting and receiving relation relative to said frequency selective member and said sub-reflector.

13. The antenna system of claim 9 wherein said frequency selective member further comprises a diplexer.

14. The antenna system of claim 9 wherein said frequency selective member further comprises a material adapted to transmit a first signal to said symmetrical reflecting surface of said sub-reflector and to reflect a second signal from said non-symmetrical reflecting surface.

15. The antenna system of claim 14 wherein said first signal further comprises a transmit signal from a feed horn and said second signal further comprises a receive signal from a satellite.

16. An antenna system comprising:

a main reflector having a line of sight axis;

a feedhorn aligned along said axis;

a sub-reflector spaced apart from said feedhorn and said main reflector, said sub-reflector having a reflecting surface symmetrically aligned relative to said axis;

a frequency selective member coupled to said sub-reflector facing said main reflector and said feedhorn, said frequency selective member having a reflecting surface non-symmetrically aligned relative to said axis; and a motor rotatably coupled to said sub-reflector and said frequency selective member.

17. The antenna system of claim 16 wherein said frequency selective member further comprises a material adapted to transmit a first signal to said symmetrical reflecting surface of said sub-reflector and to reflect a second signal from said non-symmetrical reflecting surface.

18. The antenna system of claim 17 wherein said first signal further comprises a transmit signal from said feed horn and said second signal further comprises a receive signal from said main reflector.

19. A method of transmitting and receiving signals in an antenna comprising:

a transmitting step including:

feeding a transmit signal from a feed horn to a frequency selective member having a rotating non-symmetric reflecting surface;

passing the transmit signal through the rotating non-symmetric reflecting surface of the frequency selective member to a sub-reflector having a symmetric reflecting surface;

reflecting the transmit signal from the symmetric reflecting surface of the sub-reflector to a main reflector; and reflecting the transmit signal from the main reflector to a desired satellite; and a receiving step including:

receiving a receive signal from the desired satellite at the main reflector;

reflecting the receive signal from the main reflector to the rotating non-symmetrical reflecting surface of the frequency selective member; and reflecting the receive signal from the rotating non-symmetric reflecting surface of the frequency selective member to the feed horn.

20. The method of claim 19 further comprising rotating the sub-reflector with the rotating non-symmetric reflecting surface of the frequency selective member.

* * * * *

UNITED STATES PATENT AND TRADEMARK OFFICE

CERTIFICATE OF CORRECTION

PATENT NO. : 6,680,711 B2
DATED : January 20, 2004
INVENTOR(S) : Desargant et al.

It is certified that error appears in the above-identified patent and that said Letters Patent is hereby corrected as shown below:

Title page,
Item [56], References Cited, U.S. PATENT DOCUMENTS, please add the following:

| | | |
|---|---|---|
| -- 4,017,865 | 04/12/1977 | Woodward |
| 4,305,075 | 12/08/1981 | Salvat et al. |
| 5,384,575 | 01/24/1995 | Wu |
| 5,576,721 | 11/19/1996 | Hwang et al. -- |

OTHER PUBLICATIONS, add the following:
-- EHF/SHF Antennas with Shaped Dual-Reflectors by Yueh-Chi Chang, 1990 IEEE Journal, 4 pages
International Search Report dated April 17, 2003 for PCT/US/03/00484, 5 pages --

Column 1,
Line 46, "used" should be -- use --

Signed and Sealed this

Twenty-ninth Day of June, 2004

JON W. DUDAS
*Acting Director of the United States Patent and Trademark Office*